US007022359B2

(12) United States Patent
Montserrate Gibernau

(10) Patent No.: US 7,022,359 B2
(45) Date of Patent: Apr. 4, 2006

(54) PACKAGING ASSEMBLY FOR FOOD PRODUCTS TO BE COOKED OR HEATED IN MICROWAVE OVENS

(76) Inventor: Antonio Montserrate Gibernau, C. Avenir, 72 3° la, 08021 Barcelona (ES)

( * ) Notice: Subject to any disclaimer, the term of this patent is extended or adjusted under 35 U.S.C. 154(b) by 115 days.

(21) Appl. No.: 09/829,219

(22) Filed: Apr. 9, 2001

(65) Prior Publication Data

US 2002/0037344 A1 Mar. 28, 2002

(30) Foreign Application Priority Data

Sep. 22, 2000 (ES) ..... 20002293

(51) Int. Cl.
*B65D 81/34* (2006.01)
*B65D 73/00* (2006.01)

(52) U.S. Cl. ..... 426/107; 426/112; 426/113; 426/126; 426/127

(58) Field of Classification Search ..... 426/107, 426/113, 124, 126, 127, 234, 243, 112, 118
See application file for complete search history.

(56) References Cited

U.S. PATENT DOCUMENTS

| | | | | |
|---|---|---|---|---|
| 3,322,319 | A * | 5/1967 | Stroup et al. | 426/106 |
| 4,219,573 | A * | 8/1980 | Borek | 426/107 |
| 4,390,554 | A * | 6/1983 | Levinson | 426/232 |
| 4,734,288 | A * | 3/1988 | Engstrom et al. | 426/107 |
| 4,890,439 | A * | 1/1990 | Smart et al. | 53/410 |
| 4,911,938 | A | 3/1990 | Fisher et al. | 426/107 |
| 4,950,859 | A * | 8/1990 | Anderson | 219/727 |
| 5,171,950 | A * | 12/1992 | Brauner et al. | 219/727 |
| 5,317,118 | A * | 5/1994 | Brandberg et al. | 219/727 |
| 5,357,086 | A * | 10/1994 | Turpin et al. | 219/732 |
| 5,630,959 | A * | 5/1997 | Owens | 219/730 |
| 5,679,278 | A * | 10/1997 | Cox | 219/730 |
| 6,027,802 | A | 2/2000 | Lin | 428/343 |
| 6,436,457 | B1 * | 8/2002 | Poss | 426/107 |
| 6,464,104 | B1 * | 10/2002 | Waddell | 221/150 A |

FOREIGN PATENT DOCUMENTS

| | | |
|---|---|---|
| FR | 2255230 | 7/1975 |
| GB | 2115379 | 9/1983 |

OTHER PUBLICATIONS

Merriam-Webster Dictionary OnLine, http://www.m-w.com/cgi-bin/directory.*

* cited by examiner

*Primary Examiner*—Milton I. Cano
*Assistant Examiner*—Robert Madsen
(74) *Attorney, Agent, or Firm*—Steinberg & Raskin, P.C.

(57) ABSTRACT

It comprises an inner wrapper which contains the food product, an outer package of plastic material which encloses said inner wrapper, a layer of a heat-concentrating material, arranged adjacent the inner wrapper, and a substrate attached to an outer face of said outer package. The layer of heat-concentrating material causes the opening of the outer package by melting a portion thereof, during heating of the assembly in a microwave oven, and the substrate prevents the outer package from sticking to the base of the oven. There can also be a sheet of insulating material between the inner wrapper and the outer package.

Handling operations are reduced and the protection and optimum degree of humidity are maintained until the time the product is put in the oven.

14 Claims, 2 Drawing Sheets

FIG. 1
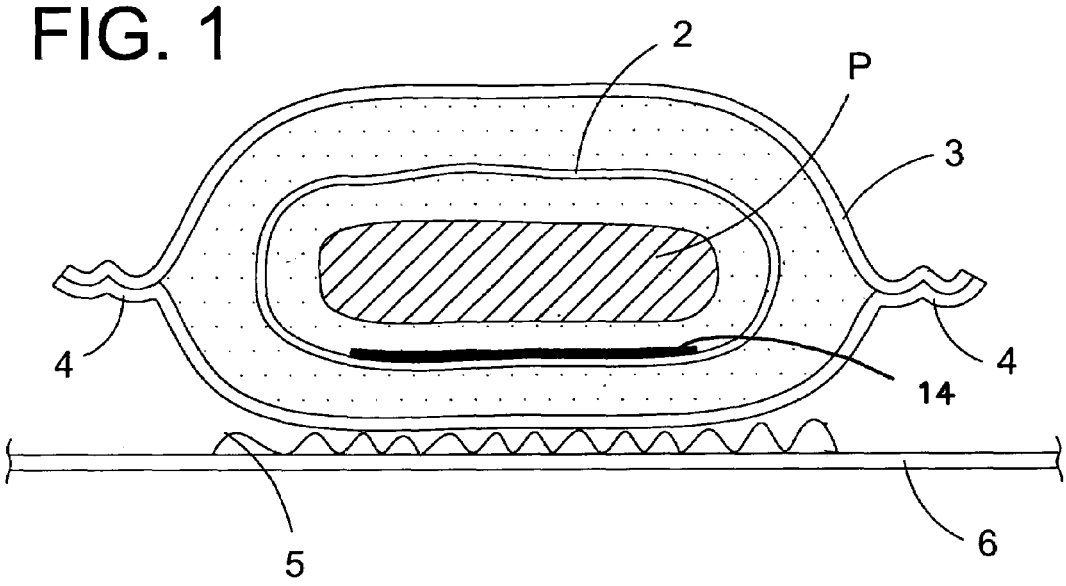
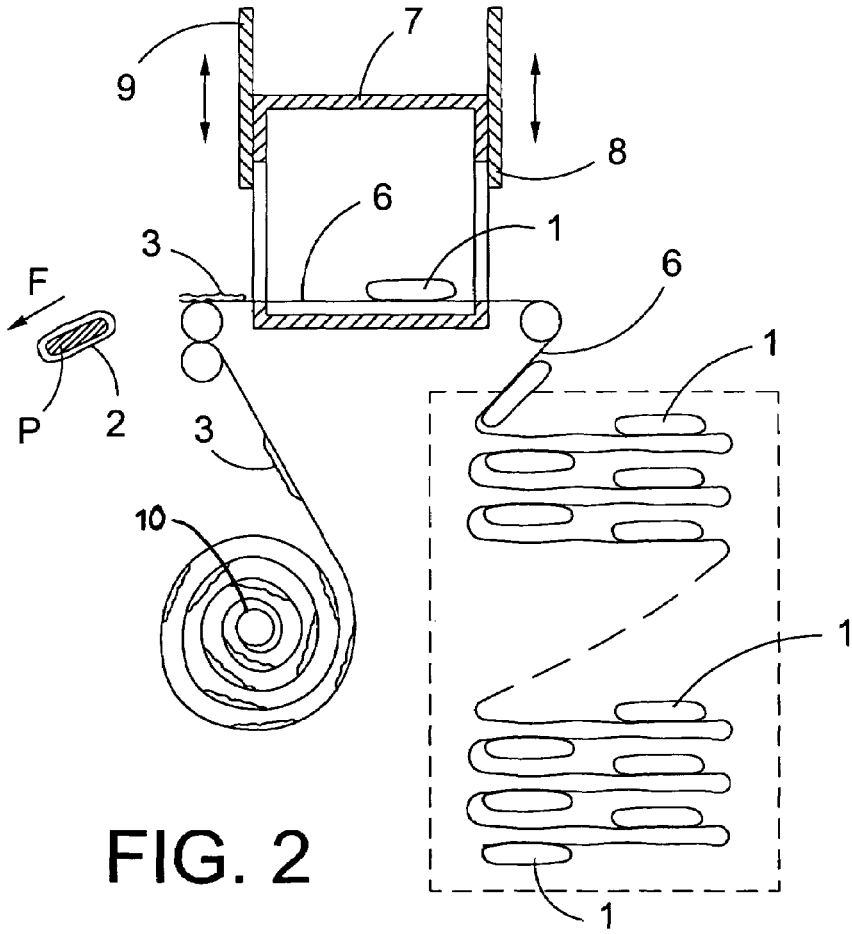
FIG. 2

PACKAGING ASSEMBLY FOR FOOD PRODUCTS TO BE COOKED OR HEATED IN MICROWAVE OVENS

The present invention relates to a packaging assembly for food products to be cooked or heated in microwave ovens.

The packaging of food products to be cooked or heated in a microwave oven, both in vending machines and for household use, generally includes an outer bag of plastic material and an inner wrapper or paper or the like.

The inner wrapper of paper or the like remains with the product throughout the storage, heating and supply of the product to the consumer.

The outer bag of plastic material serves to protect and preserve the product and to maintain a suitable degree of humidity, and is withdrawn before the product is placed in the oven, since in the majority of cases (for example, where the product is popcorn) the plastic bag would break and/or melt due to the heat generated, and therefore it would stick to the base of the oven, during heating.

This need to remove the plastic bag involves some severe disadvantages, especially in the case of vending machines; the main disadvantages are that it means an additional operation has to be carried out when the bags of popcorn or other product are loaded into the machine, and that it does not allow to leave the products in the plastic bag until the time they are consumed, so that in most cases the products will lose the right degree of humidity and their organoleptic qualities will be adversely affected.

In practice, popcorn wrappers without their outer bag progressively loose the original degree of humidity, between the fourth and the seventh storage day, and they take up the degree of humidity of the surrounding air. This alteration in humidity affects very negatively the corn, such that when it is heated a high number of the grains do not explode, and those that explode do it with a smaller volume.

Another disadvantage of the described packaging is that the inner paper wrapper is porous, and the fats and other residues from the popcorn or other products make the oven dirty during heating. This problem arises both in household environments and in the case of food-dispensing machines, with the aggravating factor, in the case of the latter, that residues and fat accumulated in the oven can catch fire.

The aim of the present invention is to develop a packaging assembly for products that are to be cooked or heated in microwave ovens and that does not have the mentioned drawbacks.

In accordance with this aim, the packaging assembly of the present invention is characterized in that it comprises an inner wrapper which contains the food product, an outer package of plastic material which encloses said inner wrapper, a layer of a heat-concentrating material, arranged adjacent the inner wrapper, and a substrate attached to an outer face of said outer package, wherein said layer of heat-concentrating material causes the opening of the outer package by melting a portion thereof, during heating of the assembly in a microwave oven.

These features allow the entire packaging assembly to be placed in the microwave oven, without having to remove the outer package first, thereby reducing handling operations and keeping the product protected and at the optimum degree of humidity up to the time it is placed in the oven.

The layer of heat-concentrating material guarantees the opening of the outer package by melting, by virtue of the high temperatures achieved.

Thus, the melting of the plastic of the outer package at some zones due to heat generated by the layer of heat-concentrating material, the pressure of the steam generated by the product as it heats up, and, in the case of popcorn, the increase in volume of the product itself, lead to opening of the outer package.

The presence in the oven of the substrate and of the outer package prevents the base of the oven from being dirtied by fat from the product that can pass through the inner wrapper, which is usually made of paper and is therefore porous.

The presence of the substrate also prevents the possibility of the plastic of the outer package being left stuck to the base of the oven due to the increase in temperature.

Advantageously, the assembly further comprises a sheet of a heat-insulating material, attached to the outer package on the inner part thereof.

The insulating sheet prevents the inner wrapper from becoming adhered to the outer package due to the melting of the latter; however, its presence does not hinder melting of the outer package, because it is enough to give an adequate size to the insulating sheet and to the layer of heat-concentrating material to ensure that the fusion of the outer package takes place, for example, along three sides of the insulating sheet.

This embodiment has the advantage that it prevents the outer package and the substrate from remaining adhered to the inner wrapper; therefore, when the assembly is withdrawn from the oven, the clean inner wrapper, on one side, and the outer package with the substrate and the insulating sheet, on the other side, can be separated. This separation operation can be easily made in automatic manner.

In an embodiment particularly suitable for automatic dispensing machines, the substrate is made up of a continuous web of flexible material, common to a plurality of products, each with its outer package and its inner wrapper.

This arrangement means that the products to be supplied can be kept in a minimum space and do not require any kind of further manipulation when they are loaded into the machine; moreover, the products do not have be loaded one by one.

The continuous web can be made to pass inside the oven and therefore constitutes an effective and cheap way of placing the products in the oven and removing them from it; the products are placed in the oven in optimum condition and supplied to the consumer clean, in their inner wrappers. All the disposable materials and the residues are removed from the machine simply by withdrawing the used roll of web.

In short, the continuous web saves space in the machine and minimizes the presence of auxiliary systems.

In another embodiment, more suitable for household use, the substrate is made up of a sheet of a size equal to or smaller than that of the outer package.

In both cases, the substrate is preferably made of paper.

In one embodiment, the outer package has at least one area with two sheets of material, the layer of heat-insulating material being inserted therebetween.

This embodiment is advantageous because it allows to use conventional microwave popcorn bags, which are already prepared with the layer of heat-concentrating material.

Alternatively, the layer of heat-concentrating material is applied as a coating on the sheet of insulating material.

This embodiment is particularly convenient for products other than popcorn, such as waffles.

The heat-concentrating material is advantageously an oxide of aluminum.

In accordance with some optional characteristics, the outer package is attached to the substrate by means of an adhesive, and/or the sheet of insulating material is attached to the outer package by means of an adhesive.

Preferably, the outer package is made of polyethylene and the inner wrapper is made of paper.

The outer package presents advantageously at least one weld-line of a predetermined strength, which facilitates the opening of the outer package during heating.

The weld-lines keep the packaging closed up to the time it is placed in the oven, while they also allow it to open easily during heating, by virtue of the steam released by the product, and/or by virtue of its increase in volume, in the case of popcorn.

For a better understanding of all that has been set out some drawings are attached which show schematically and solely by way of non-limiting example a practical case of embodiment.

In said drawings,

FIG. 1 is a section view of a first embodiment of the packaging assembly in accordance with this invention;

FIG. 2 is a section view of a packaging assembly adapted for popcorn; and

Figure 3:
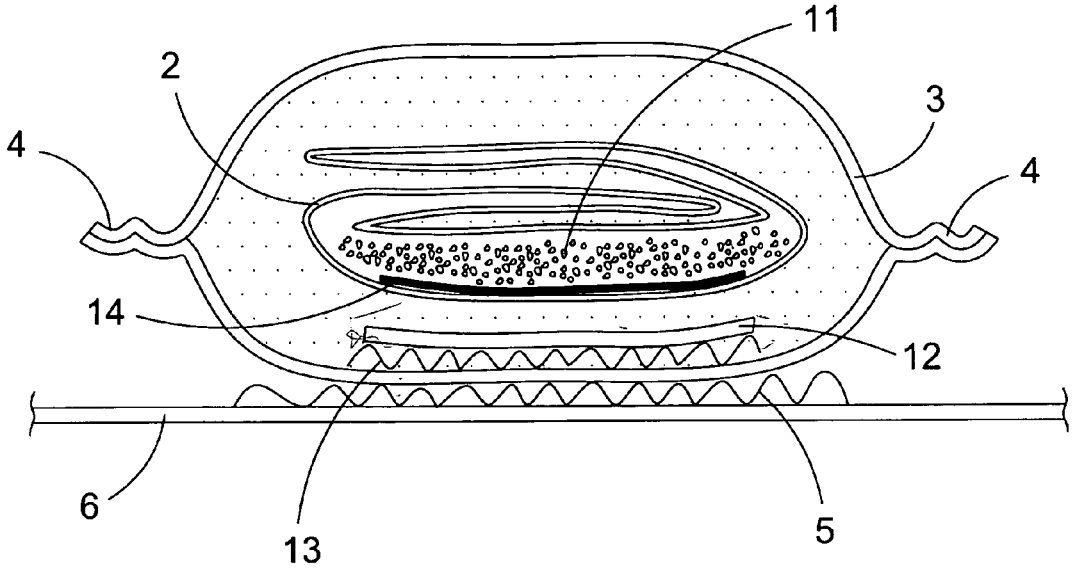
FIG. 3 is a section view of a packaging assembly suitable for other products, in this case waffles.

FIG. 1 shows a packaging assembly 1 in accordance with the invention in its simplest expression; it includes an inner paper wrapper 2 which surrounds the product P and is in turn inserted into an outer package 3 of plastic material which has thermowelded lines 4.

The assembly also comprises a layer of heat-concentrating material or "suscepter" 14, for example adhered to the inner wrapper 2; this layer is usually made up as a sandwich of metal (in general aluminum oxide) between two sheets of paper.

The high temperatures (about 500° C.) reached by the suscepter in the oven favor the heating of the product; in the present invention the suscepter has the further function of causing the opening of the outer package 3, as will be apparent below.

The outer package 3 is attached by means of a layer of adhesive 5 onto a substrate 6 of paper of a size at least equal to that of the suscepter. This substrate 6 could consist, for example, in an adhesive label.

For the purpose of greater simplicity, the outer package 3 will hereinafter be termed "bag", though this term must not be interpreted in a limiting manner, since the outer package can adopt forms different from those of a bag; for example, it could be a strip placed around the top part of the inner wrapper and attached by its perimeter to the substrate 6.

The weld-lines 4 can be of any form suitable for the product, and may have a resistance such that they give way under the pressure of the steam generated by heating of the product or, in the case of popcorn, the pressure exercised by inflation of the inner wrapper 2.

During heating the layer of heat-concentrating material 14, apart from heating the product P, causes melting of a portion of the bag 3, which is made of plastic; at the same time the weld-lines give way and the bag 3 opens by effect of the melting of a portion of the bag and the opening of the weld lines.

FIG. 3 shows another embodiment of the packaging assembly 1, very convenient for popcorn.

In this case, the inner wrapper 2 is of the type conventionally used for popcorn ready for microwave ovens, which includes on its lower part, incorporated into the inner wrapper itself, a layer of heat-concentrating material (suscepter), shown in the figure as a dark line; the inner wrapper 2 has two wings folded over each other that open and permit inflation of the bag as the grains of corn 11 explode.

This embodiment is further provided with a sheet of insulating material 12, such as a thin cardboard, between the inner wrapper 2 and the bag 3, underneath the product P. The sheet 12 has an adequate size, with respect to the suscepter 14, such that the heat generated by the latter melts the bag 3 along three sides of the sheet; thus, the heat of the suscepter is still used to open the bag 3, but at the same time the insulating sheet 12 prevents the outer bag 3 from sticking to the inner wrapper 2 upon melting.

In order to allow that this cardboard or insulating sheet 12 is disposed of together with the bag 3, it is attached to the bag by means of a layer of adhesive 13, while the inner wrapper 2 is left simply resting on the sheet 12.

FIG. 3 shows a packaging assembly similar to that of FIG. 2, for a product P other than popcorn, for example a waffle G.

Like in the previous cases, the waffle G is enclosed in an inner wrapper 2, made of ordinary paper, and in the bag 3, the latter being attached to the substrate 6 by means of adhesive 5. An insulating sheet 12 is attached by means of adhesive 13 to the bag 3. In this case, however, a layer 14 of heat-concentrating material, normally aluminum oxide, is placed on the insulated sheet 12. The layer 14 can be deposited on the sheet 12 as a coating, or fixed using a suitable adhesive.

The layer 14 is positioned underneath the paper wrapper 2 and improves heating of the waffle.

Furthermore, as already mentioned, an advantage of the heat-concentrating layer of material is that the high temperatures reached partly melt the outer package; thus, in combination with opening of the weld-lines under the action of the steam pressure or the increase in volume of the product, the release of the inner wrapper that holds the product is ensured.

In the case of the embodiments of FIGS. 2 and 3, thanks to the presence of the sheet of insulating material 12, when the assembly is withdrawn from the oven the inner wrapper 2 remains separate from the outer package 3, which has partially melted and has opened.

Figure 4:
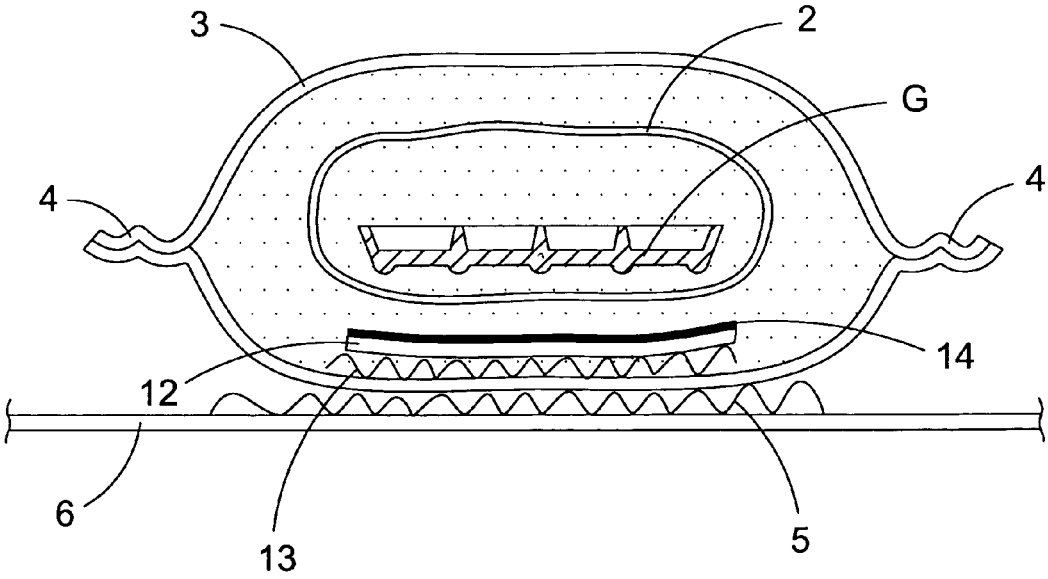
FIG. 4 shows schematically some elements of a machine for dispensing products heated by microwave oven which uses products with the packaging assembly of the invention.

FIG. 4 shows highly schematically how the described packaging assembly 1 can be used very advantageously in vending machines equipped with a microwave oven 7 having an input door 8 and an output door 9 for the products, simply by placing a plurality of bags with products on a continuous web of substrate 6.

The web of substrate 6 with the bags, folded into a zigzag, of itself constitutes a means for storing and loading the products in the machine; the web 6 is made to pass inside the oven 7, and at the exit it is wound on a take-up spool 10.

When the web 6 advances after a heating cycle, the product P that has been heated is supplied to the consumer together with its inner wrapper 2, for example simply by dropping, as shown by the arrow F, while the bag 3 remains stuck to the web.

Despite the fact that one specific embodiment of the invention has been described and shown, it is obvious that a man skilled in the art is able to introduce variations and modifications, or replace the details by others that are technically equivalent, without departing from the scope of protection defined by the attached claims.

For example, although this specification makes reference only to some food products, it is obvious that the described packaging can be used for any other product intended to be heated in an oven, and particularly in a microwave oven, before being consumed. Similarly, the packaging could contain other additional items, such as a sachet of chocolate sauce in the case of waffles.

The materials of the various elements making up the packaging may be different from those described by way of example, as long as they have the characteristics necessary to carry out their function.

The invention claimed is:

1. A packaging assembly for food products to be cooked or heated in microwave ovens, which comprises:

an inner wrapper which contains the food product;

an outer package of plastic material which encloses said inner wrapper and at least one layer of a suscepter material; and a substrate attached to an outer face of said outer package;

wherein said at least one layer of suscepter material causes the opening of the outer package by melting a portion of the outer package, and a portion of the outer package is melted to permit removal of the inner wrapper from the outer package during heating of the assembly in a microwave oven, and said packaging assembly is used in automatic dispensing machines equipped with said microwave ovens;

wherein the substrate is a continuous web of flexible material attached to a plurality of said outer packages, wherein each of said outer packages encloses said inner wrapper, which contains said food product, and at least one layer of suscepter material; and wherein the food product is corn which is transformed into popcorn.

2. A packaging assembly as claimed in claim 1, further comprising a sheet of a heat-insulating material, attached to an inner part of the outer package.

3. A packaging assembly as claimed in claim 1, wherein the substrate is made up of a sheet of a size equal to or smaller than that of the outer package.

4. A packaging assembly as claimed in claim 1, wherein the substrate is made of paper.

5. A packaging assembly as claimed in claim 1, wherein the inner wrapper comprises at least one area having two sheets of material, and wherein the layer of suscepter material is inserted between said two sheets of material.

6. A packaging assembly as claimed in claim 2, wherein the layer of suscepter material is applied as a coating onto the sheet of insulating material.

7. A packaging assembly as claimed in claim 1, wherein said suscepter material is an oxide of aluminum.

8. A packaging assembly as claimed in claim 1, wherein the outer package is attached onto the substrate by means of an adhesive.

9. A packaging assembly as claimed in claim 2, wherein the sheet of insulating material is attached to the outer package by means of an adhesive.

10. A packaging assembly as claimed in claim 1, wherein the outer package is made of polyethylene and the inner wrapper is made of paper.

11. A packaging assembly as claimed in claim 1, wherein the outer package presents at least one weld-line of a predetermined strength, wherein said at least one weld-line facilitates the opening of the outer package during heating.

12. A packaging assembly as claimed in claim 1, wherein said at least one layer of suscepter material further comprises:

at least one strip of suscepter material.

13. A packaging assembly as claimed in claim 12, wherein said at least one strip of suscepter material is applied on said outer package.

14. A packaging assembly for food products to be cooked or heated in microwave ovens, which comprises:

an inner wrapper made of paper which contains the food product;

an outer package of plastic material which encloses said inner wrapper and at least one layer of a suscepter material; and a substrate attached to an outer face of said outer package;

wherein said at least one layer of suscepter material causes the opening of the outer package by melting a portion of the outer package, and a portion of the outer package is melted to permit removal of the inner wrapper from the outer package during heating of the assembly in a microwave oven, and said packaging assembly is used in automatic dispensing machines equipped with said microwave ovens;

wherein the substrate is a continuous web of flexible material attached to a plurality of said outer packages, wherein each of said outer packages encloses said inner wrapper, which contains said food product, and at least one layer of suscepter material; and wherein the food product is corn which is transformed into popcorn.

* * * * *